US010472860B2

(12) United States Patent
Duchstein et al.

(10) Patent No.: US 10,472,860 B2
(45) Date of Patent: Nov. 12, 2019

(54) SAFE BAG MODULE HAVING A HANDLE WITH ONE-SIDED TORQUE TRANSMISSION

(71) Applicant: Wincor Nixdorf International GmbH, Paderborn (DE)

(72) Inventors: Mirko Duchstein, Berlin (DE); Nicolas Boesendorfer, Hohen Neuendorf (DE); Ruediger Wundersee, Koelleda (DE)

(73) Assignee: Wincor Nixdorf International, GmbH, Paderborn (DE)

( * ) Notice: Subject to any disclaimer, the term of this patent is extended or adjusted under 35 U.S.C. 154(b) by 722 days.

(21) Appl. No.: 15/065,121

(22) Filed: Mar. 9, 2016

(65) Prior Publication Data

US 2016/0281392 A1 Sep. 29, 2016

(30) Foreign Application Priority Data

Mar. 27, 2015 (EP) ..... 15161395

(51) Int. Cl.
*E05B 65/52* (2006.01)
*E05B 65/46* (2017.01)
(Continued)

(52) U.S. Cl.
CPC ..... *E05B 65/5246* (2013.01); *E05B 47/0696* (2013.01); *E05B 65/461* (2013.01);
(Continued)

(58) Field of Classification Search
CPC ..... Y10T 292/08; Y10T 292/0801; Y10T 292/081; Y10T 292/0825; Y10T 292/0826;
(Continued)

(56) References Cited

U.S. PATENT DOCUMENTS 1,551,506 A * 8/1925 Parsons ..... E05C 9/08 292/118
1,723,020 A * 8/1929 Erwin ..... E05B 65/52 70/72

(Continued)

FOREIGN PATENT DOCUMENTS

WO WO-2009045936 A1 * 4/2009 ..... E05B 13/00
WO WO-2011014041 A2 * 2/2011 ..... G07D 11/0006

OTHER PUBLICATIONS

European Search Report.

(Continued)

*Primary Examiner* — Alyson M Merlino
(74) *Attorney, Agent, or Firm* — Black, McCuskey, Souers & Arbaugh, LPA

(57) ABSTRACT

A device (10) for receiving notes of value has a receiving area (12) for receiving notes of value and a shaft (20) with one hook (26, 28) at each end. The hooks are movable between a locking position and an unlocked position by rotation of the shaft (20). A handle (14) is arranged on the shaft (20) so that the shaft (20) runs through a first hole (34) and a second hole (36) at both ends (16, 18) of the handle (14). The first hole (34) is formed so that upon rotation of the handle (14) within a predetermined range, a torque is transmittable to the shaft (20) via engagement between the shaft (20) and the first end (16) of the handle (14). The second hole (36) is formed so that upon rotation of the handle (14) no torque is transmitted to the shaft (20) via the second end (18).

19 Claims, 7 Drawing Sheets

(51) Int. Cl.

| | |
|---|---|
| ***E05C 9/08*** | (2006.01) |
| ***G07G 1/00*** | (2006.01) |
| ***E05C 9/00*** | (2006.01) |
| ***E05C 19/12*** | (2006.01) |
| ***E05B 47/06*** | (2006.01) |
| ***E05C 3/14*** | (2006.01) |
| ***G07D 11/12*** | (2019.01) |
| *E05B 47/00* | (2006.01) |

(52) U.S. Cl.
CPC ..... *E05C 3/14* (2013.01); *E05C 9/00* (2013.01); *E05C 9/08* (2013.01); *E05C 19/12* (2013.01); *G07D 11/12* (2019.01); *G07G 1/0027* (2013.01); *E05B 47/0002* (2013.01)

(58) Field of Classification Search
CPC ..... Y10T 292/0828; Y10T 292/0831; Y10T 292/0848; Y10T 292/0849; Y10T 292/0851; Y10T 292/0853; Y10T 292/0854; Y10T 292/0857; Y10T 292/0862; Y10T 292/57; Y10T 292/1049; E05B 65/52; E05B 65/5246; E05B 65/5269; E05B 65/5276; E05B 65/46; E05B 65/461; E05B 47/0696; E05B 47/0002; E05B 47/0003; E05B 47/0004; E05B 47/06; E05B 47/0607; E05B 47/0657; E05B 47/0665; E05B 47/0669; E05C 3/14; E05C 3/16; E05C 3/162; E05C 3/22; E05C 3/30; E05C 3/34; E05C 3/40; E05C 9/00; E05C 9/08; E05C 19/12; Y10S 292/62; G07D 11/0006; G07D 11/12; G07G 1/0027
USPC ..... 312/332.1
See application file for complete search history.

(56) References Cited

U.S. PATENT DOCUMENTS

| | | | | |
|---|---|---|---|---|
| 2,891,816 | A * | 6/1959 | Meats | B62D 33/0273 292/100 |
| 4,082,077 | A * | 4/1978 | Marfatia | F24C 15/022 126/197 |
| 4,134,281 | A * | 1/1979 | Pelcin | E05B 13/10 292/210 |
| 4,660,872 | A * | 4/1987 | Carson | E05C 9/08 292/218 |
| 4,784,414 | A * | 11/1988 | Free | E05C 9/08 292/336.3 |
| 5,094,484 | A * | 3/1992 | Bang | E05C 9/08 101/269 |
| 5,213,382 | A * | 5/1993 | Dawdy | B65F 1/1615 292/228 |
| 7,686,207 | B1 * | 3/2010 | Jeffs | E05B 65/02 232/45 |
| 8,944,537 | B1 | 2/2015 | Manalang et al. | |
| 2002/0190529 | A1 * | 12/2002 | Breslin | E05B 17/0025 292/56 |
| 2009/0115198 | A1 * | 5/2009 | Kitada | E05C 9/00 292/198 |
| 2009/0217714 | A1 * | 9/2009 | O'Leary | E05C 9/08 70/84 |
| 2011/0094850 | A1 | 4/2011 | Seki | |
| 2011/0309730 | A1 | 12/2011 | Retchloff et al. | |
| 2013/0340465 | A1 * | 12/2013 | Park | E05B 65/46 312/404 |

OTHER PUBLICATIONS

"Wincor Nixdorf—Experience Meets Vision"—Feb. 18, 2014, XP05497602, Gefunden im Internet: URL:https://www.youtube.com/watch?v=oA8-rD PVFFg.

* cited by examiner

SAFE BAG MODULE HAVING A HANDLE WITH ONE-SIDED TORQUE TRANSMISSION

BACKGROUND

1. Field of the Invention

The invention relates to a device for receiving notes of value, in particular a safe bag module that comprises a receiving area for receiving notes of value. Further, the device has a shaft with a first end that has a first hook and a second end that has a second hook. The hooks are engaged with engagement elements of the device for handling notes of value when the device is inserted in a compartment of a device for handling notes of value, in particular an automated teller machine, provided that the hooks are arranged in a locking position. If, on the other hand, the hooks are arranged in an unlocked position, there is no engagement between the hooks and the engagement elements of the compartment. By rotating the shaft, the hooks can be moved between the locking position and the unlocked position. Further, a handle is arranged on the shaft and comprises a first end with a first hole and a second end with a second hole. The shaft runs through both the first and the second holes.

2. Description of the Related Art

So-called safe bag modules are used in automatic teller machines and receive safe bags that are filled with notes of value by the automated teller machine. Such safe bag modules can be removed from the automated teller machine, in particular for the removal of a filled safe bag and for the insertion of an empty safe bag. Here, the safe bag module is receivable in a specific compartment of the automated teller machine. So that the safe bag module remains in the desired position within the automated teller machine, a locking mechanism is provided and holds the safe bag module in the compartment.

In known automated teller machines, this locking mechanism is designed such that two engagement elements, in particular short pins, are provided on opposite sides in the compartment of the automated teller machine. The safe bag module has a shaft, at the ends of which one hook each is provided. By rotation of the shaft, the hooks, which are connected to the shaft in a rotationally fixed manner, can be moved between a locking position in which they are engaged with the engagement elements and an unlocked position in which there is no engagement between the hooks and the engagement elements. Here, the rotation of the shaft takes place manually by means of a handle, the two ends of which are connected to the shaft in a rotationally fixed manner. The handle in particular also serves to carry the removed safe bag module. An active locking unit is provided on one side of the compartment. In a first operating state the active locking unit prevents movement of the first hook from the locking position into the unlocked position and in a second operating state the active locking unit enables movement of the first hook from the locking position into the unlocked position. This locking unit in particular comprises a lever that is rotatable by means of a drive unit and in a first operating state is arranged such that a movement of the first hook from the locking position into the unlocked position is prevented by means of the contact with the lever.

The problem with such known safe bag modules is that by way of the only one-sidedly active locking via the locking unit of the automated teller machine, it may happen that on the other side the engagement between the second hook and the associated engagement element is disengaged unintentionally. This is in particular the case when a user pulls the handle of the safe bag module without a previous unlocking of the unlocking unit, i.e. without a change from the first into the second operating state, and in doing so the shaft is twisted so far that the second hook loses its engagement with the engagement element. As a result, it may happen that the safe bag module is no longer arranged exactly in the desired position and thus errors in the storage of the notes of value may occur.

Therefore, it is the object of the invention to specify a device for receiving notes of value, by means of which an unintended one-sided unlocking is prevented when the device is inserted into an automated teller machine or the like.

SUMMARY

According to the invention, the first hole is formed at the first end of the handle such that upon rotation of the handle at least within a predetermined range of rotation a torque is transmitted to the shaft via an engagement between the shaft and the first end of the handle. The second hole is, however, formed such that upon rotation of the handle no torque is transmitted to the shaft via the second end. As a result, it is guaranteed that the torque transmission to the shaft takes place only on one side of the handle, namely on the side of the first end region. When the device for receiving notes of value is inserted in a device for handling notes of value, in particular an automated teller machine, it is arranged such that the first hook is arranged on that side on which the locking unit for the active locking is provided. Owing to the fact that the torque is now no longer transmitted on both sides of the handle when pulling the handle but only at that end which is closer to the first hook and thus closer to the active locking unit of the compartment of the automated teller machine, the shaft will be less twisted on the side of the second hook, i.e. that side on which no active locking unit for holding the second hook in the locking position is provided in the compartment, as a result whereof it is prevented that, when pulling the handle despite an active locking via the locking unit of the compartment, the second hook does not lose its engagement with the corresponding engagement element of the compartment. If, on the other hand, the active locking unit of the compartment is in the second operating state so that it does not prevent the movement of the first hook from the locking position into the unlocked position, then the shaft can be rotated as usual via the torque transmission at the first end, wherein on both sides an unlocking takes place, i.e. that both hooks are moved from the locking position into the unlocked position via the rotation of the shaft.

In one embodiment of the invention, the second hole has a circular cross-section, wherein the diameter of the second hole is greater than the maximum width of the shaft so that the shaft can rotate in the second hole without a transmission of a torque. In particular, the diameter of the second hole is only slightly smaller than the maximum width of the shaft so that when carrying the safe bag module the weight force is transmitted via both ends of the handle from the shaft to the handle and the safe bag module, as in the case of known safe bag modules, can easily be handled.

The shaft may have a rectangular basic body, by means of which upon rotation of the handle an engagement with the first end of the handle can easily be established so that a torque transmission takes place and the shaft can be rotated reliably and easily.

In another embodiment of the invention, on a first side of the basic body and on a second side of the basic body opposite to the first side one projection each is provided which has a circular-segment-shaped cross-section. These projections extend at least in those areas in which the shaft is passed through the first and the second hole, preferably along almost the entire length of the shaft apart from its end regions at which the hooks are arranged on the shaft. The surfaces of the circular-segment shaped cross-sections preferably have about the same curvature as the inner curvature of the second hole. Preferably, in particular the maximum dimension of the cross-section of the shaft, which in particular extends from the apex to the apex of the two projections, approximately corresponds to the diameter of the second hole. By means of these two projections, it is achieved that when carrying the safe bag module the weight force of the safe bag module can easily be transmitted to the handle also via the second end of the handle. In particular, the two projections are arranged on that side of the basic body on which the force transmission takes place when the handle is rotated by 90° relative to the surface at which it is mounted, wherein this corresponds to the position in which the handle is arranged when carrying the safe bag module.

When the safe bag module is arranged in the compartment of the automated teller machine, the handle is arranged in particular in a zero position, wherein in this zero position it bears against the housing of the module. When the handle is arranged in the zero position, the shaft is rotated such that the hooks are arranged in the locking position. For removing the safe bag module and for disengaging the engagement between the hooks and the engagement elements of the compartment, the lever is moved out of the zero position and thus rotated away from the housing. When carrying the safe bag module, the handle is in particular moved out of the zero position approximately by an angle of 90°.

The first hole is in particular formed such that is has a circular cross-section, into which at least one projection projects. In particular, two projections which are arranged offset by 180° project into the circular cross-section.

The diameter of the circular cross-section may correspond to the diameter of the second hole. Upon rotation of the handle the engagement between the first end region of the handle and the shaft is established by means of the projection or the projections so that via this engagement a torque can be transmitted from the handle onto the shaft for rotation of the shaft and in particular for unlocking the locking.

The handle may comprise a basic body and a reinforcing element in the area of the first end of the handle, wherein a first portion of the first hole extends through the basic body and a second portion of the first hole extends through the reinforcing element, i.e. is delimited by the reinforcing element and the basic body, respectively.

In one embodiment, the first portion has a circular cross-section and the second portion has a circular cross-section into which a projection, preferably two projections project. Thus, the engagement between the first end of the handle and the shaft is exclusively established via the reinforcing element. As a result, a particularly simple production is achieved since in the basic body only two holes, the first and the second hole, have to be provided which have the simple, identical, circular cross-section.

The basic body may be made of plastic, the reinforcing element is made of metal. By providing a reinforcing element made of metal a sufficient torque can be transmitted also via the only one-sided torque transmission.

The reinforcing element may be formed in a disk-shaped manner and may be arranged laterally on the side of the basic body where the first end is located. Thus, a particularly simple production and assembly is achieved. The disk-shaped engagement element is in particular pressed into the plastic basic body.

Further, it is advantageous when the reinforcing element has at least one recess into which a rib of the basic body projects. In this way, a better and more uniform force transmission from the reinforcing element to the basic body is achieved. Preferably, still further recesses can be provided through which pins extend, via which likewise a force transmission takes place and via which the reinforcing element is held on the basic body.

In a further embodiment of the invention, the projection is formed within the first hole such that starting out from the zero position of the handle, the shaft is not engaged with the projection upon a rotation within a first angular range so that there is no transmission of a torque from the handle to the shaft so that the shaft, independent of whether the locking unit of the compartment permits a rotation of the hook from the locking position into the unlocking position, is not rotated as well. When the handle is rotated within a second angular range following the first angular range, which thus corresponds to the afore-mentioned predetermined area, there is an engagement between the projection and the shaft so that the transmission of the torque from the handle to the shaft takes place and a rotation of the shaft and thus an unlocking of the safe bag module can take place.

By means of this free lift in the first angular range it is achieved that a person can rotate the handle bearing against the housing in the zero position at first so far away from the housing that he/she can fully grasp the handle, wherein then, upon a further rotation of the handle, the torque transmission between the handle and the shaft takes place.

In another embodiment of the invention, the first hook is mounted in a rotationally fixed manner at the first end of the shaft, i.e. there is no play between the hook and the shaft and upon a rotation of the shaft the hook is each time rotated as well or, provided that a rotation of the hook is prevented externally, a corresponding force transmission from the handle to the shaft immediately takes place. The second hook, on the other hand, is mounted on the shaft with a predetermined play so that the shaft can be rotated within the angular range predetermined by the play without the hook being rotated as well or without there being a force or torque transmission from the shaft to the second hook.

By means of this play, too, just like by means of the play between the shaft and the second hole of the handle, a one-sided unlocking is prevented. When by means of the locking unit of the compartment the first hook is prevented from being moved from the locking position into the unlocked position and nevertheless the handle is pulled so that a torque is exerted on the shaft, it may indeed happen that the shaft is slightly twisted. However, by means of the play between the shaft and the second hook it is achieved that within the predetermined play no transmission of the torque to the second hook takes place and the latter is not rotated as well when the shaft is twisted so that the engagement with the engagement element remains. Thus, by means of this play the safety against an unintended one-sided unlocking is increased further since, even when by means of an extremely high force exerted on the handle a residual twisting of the shaft is caused, a rotation of the second hook is nevertheless prevented by means of the play.

The play may be between 3° and 7°, preferably is about 5°. Thus, the play is chosen sufficiently large that even in the case of high forces transmitted to the shaft and a correspondingly high twisting of the shaft there is still an engagement between the second hook and the corresponding engagement element.

In a further embodiment of the invention, the shaft has a rectangular cross-section at its two ends, at which no projections are provided, as in the central area of the shaft.

The first hook has a recess into which the first end of the shaft engages. The recess of the first hook has the same cross-section as the first end of the shaft so that the shaft is press-fit into the cross-section and the first hook is thus mounted on the shaft without play. The second hook, too, has a recess into which the second end of the shaft engages. The recess of the second hook likewise has a rectangular cross-section, this one however being larger than the cross-section of the shaft at the second end. In particular, both side lengths of the rectangular cross-section of the recess are each time larger than the corresponding side length of the cross-section of the second end of the shaft. Hereby, the above-mentioned play is achieved.

The recess of the second hook may be formed such that the cross-section results from two rectangles twisted by 5°, preferably with an edge length of 5 mm×8 mm, with the center of rotation in the center of the shaft, i.e. more or less projections, as already described in the case of the handle, which permit a torque introduction in one range of rotation and do not permit it in the other.

Further, it is advantageous when the second hook is biased on the shaft by an elastic element, in particular a spring, opposite to the direction of rotation in which the shaft has to be rotated for unlocking. Thus, it is guaranteed that upon rotation of the shaft within the angular range permitted by the play the second hook is reliably held in the locking position.

The device for receiving notes of value is in particular a safe bag module in which a safe bag is receivable in the receiving area, in which safe bag in turn the notes of value are receivable as a value note stack. Alternatively, the device for receiving notes of value can also be a cash box in which the notes of value are stacked without a safe bag. Also any other device for receiving notes of value which is carried by means of a handle and in which a locking in the automated teller machine, that is unlockable by the handle, is accomplished, can be protected against a one-sided unlocking by means of the inventive handle and the further afore-mentioned features.

A further aspect of the invention relates to a device for receiving notes of value which comprises a receiving area for receiving notes of value and a shaft, wherein at a first end of the shaft a first hook and at a second end of the shaft a second hook are arranged. When the device is inserted in a compartment of a device for handling notes of value, in particular an automated teller machine, the hooks are engaged with engagement elements of the compartment of the device for handling notes of value, provided that the hooks are arranged in a locking position. If, on the other hand, the hooks are arranged in an unlocked position, there is no engagement with the engagement elements. The hooks are movable between the locking position and the unlocked position by rotation of the shaft. The first hook is mounted on the shaft in a rotationally fixed manner without play, whereas the second hook is mounted on the second end of the shaft with a predetermined play.

As a result, it is achieved that when the handle is pulled and when the first hook is held in the locking position by an active locking unit arranged in the compartment of the device for handling notes of value certainly a twisting of the shaft is caused but owing to the play the second hook is not rotated as well so that the engagement between the second hook and the corresponding engagement element of the compartment remains. Thus, an unintended one-sided unlocking is prevented.

The mounting of the second hook on the shaft can take place as previously described in the first embodiment.

A further aspect of the invention relates to a device for handling notes of value, which in particular can be an automated teller machine, an automatic cash register system or a cash safe. The device has a compartment for receiving a device for receiving notes of value of the afore-described type, in particular a safe bag module. An afore-described device for receiving notes of value is received in the compartment, wherein on a first side of the compartment a first engagement element and on a second side of the compartment opposite to the first side a second engagement element is arranged and wherein in the locking position the first hook is engaged with the first engagement element and the second hook is engaged with the second engagement element.

In one embodiment of the invention, a locking unit is arranged on the first side of the compartment, which locking unit prevents a movement of the first hook from the locking position into the unlocked position in a first operating state and permits a movement of the hook from the locking position into the unlocked position in the second operating state.

The locking unit may comprise a lever rotatably mounted about an axis of rotation and an adjustment unit with which the lever can be rotated between a first position and a second position, wherein the lever in the first position in which it is arranged in the first operating state prevents a movement of the hook by means of a contact with the hook and in a second position in which it is arranged in the second operating state, has no contact with the first hook so that it can be moved from the locking position into the unlocked position. The adjustment unit is in particular a lifting magnet.

Further features and advantages of the invention result from the following description which explains the invention in more detail on the basis of embodiments in connection with the enclosed Figures.

DETAILED DESCRIPTION

Figure 1:
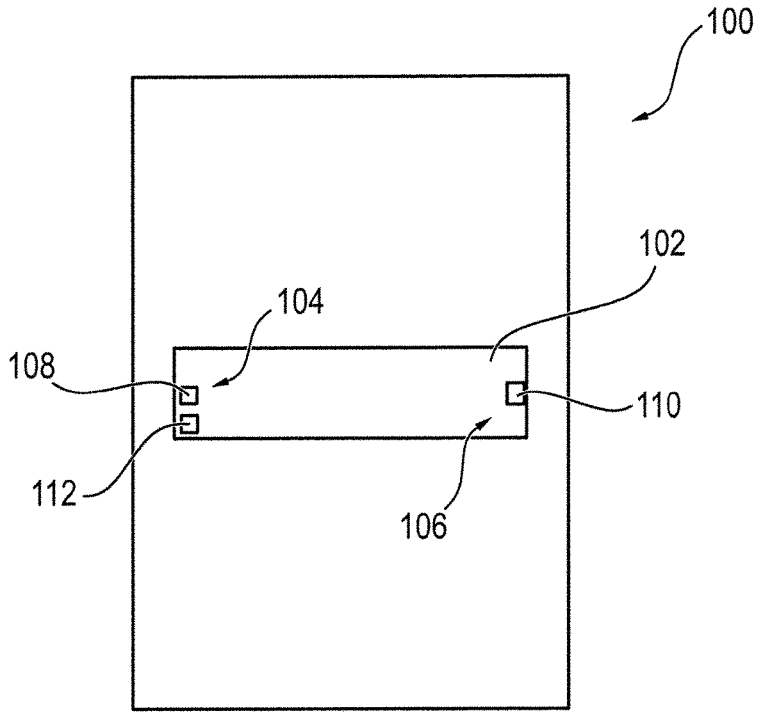
FIG. 1 shows a schematic, highly simplified illustration of a device for handling notes of value.

In FIG. 1, a schematic, highly simplified illustration of a device 100 for handling notes of value, in particular banknotes, is shown. The device 100 is in particular an automated teller machine, an automatic cash register system or an automatic cash safe.

The device 100 has a compartment 102 in which a safe bag module 10 can be received. On a first side 104 of the compartment 102, a first engagement element 108 and on a second side 106 a second engagement element 110 is provided, which, by means of the engagement with elements of the safe bag module 10 which will be described in more detail later on, hold the safe bag module in a predetermined position within the compartment 102, wherein this position is predetermined such that by means of a feeding and stacking module of the device 100 notes of value can be fed to the safe bag arranged in the safe bag module 10.

On the first side 104, further an active locking unit 112 is provided by which an active locking can be implemented. By active locking it is understood that via this locking unit 112 a disengagement of the engagement between the engagement element 108 and the corresponding complementary element 26 of the safe bag module 10 is prevented when the locking unit 112 is in a first operating state.

Figure 2:
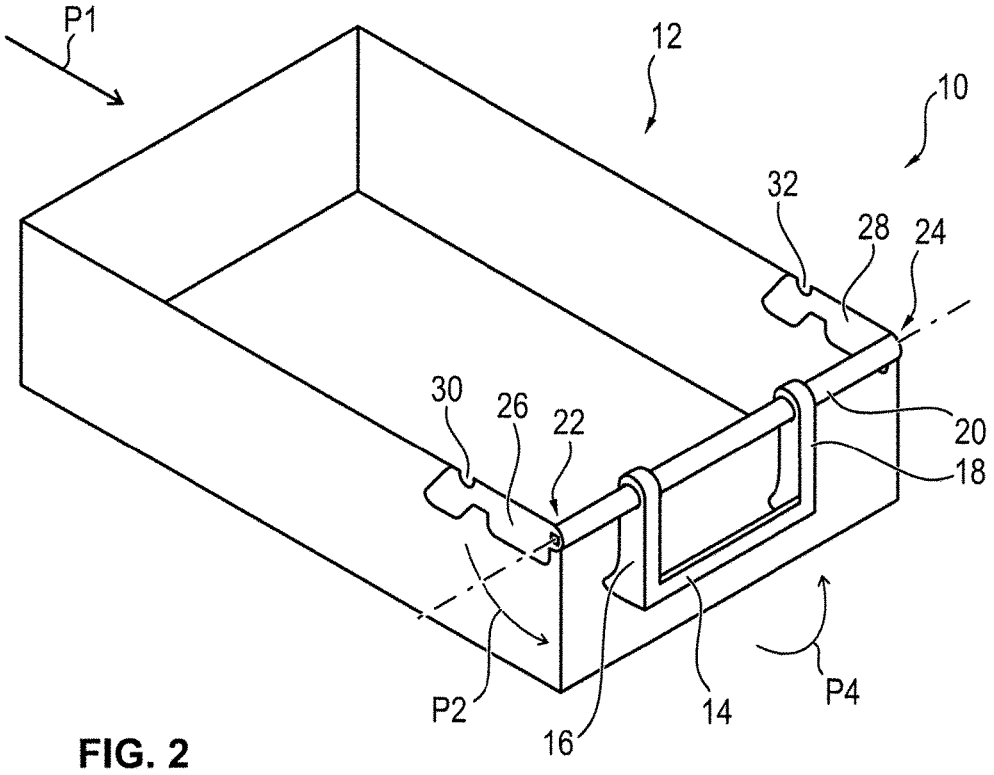
FIG. 2 shows a schematic, highly simplified illustration of a safe bag module.

In FIG. 2, a schematic, perspective, highly simplified illustration of a safe bag module 10 is shown, which can be inserted into the compartment 102 of the device 100. The inventive handling and locking mechanisms described in the following can, of course, also be used for all other devices for receiving notes of value, such as cash boxes, which have a corresponding handle and are locked by means of corresponding engagement elements 108, 110 in the device 100.

The safe bag module 10 has a receiving area 12 in which a safe bag is arranged in a manner stretched over non-illustrated elements. The notes of value are fed to the safe bag in the direction of the arrow P1.

On the side of the safe bag module 10 opposite to the feeding side, a handle 14 is arranged, by means of which the safe bag module 10 can be removed from the compartment 102 and carried. The handle 14 is mounted on a shaft 20 via a first end 16 and a second end 18. At a first end 22 of the shaft 20, a first hook 26 and at a second end 24 opposite to the first end a second hook 28 is arranged. The hook 26 has a recess 30 and the hook 28 has a recess 32, via which the engagement with the engagements elements 108, 110 can be established when the safe bag module 10 is inserted in the compartment 102 and the hooks 26, 28 are arranged in the locking position shown in FIG. 2. In this locking position, the engagement elements 108, 110 are arranged in the recesses 30, 32 of the hooks 26, 28.

By moving the handle 14 in the direction of the arrow P4 and a rotation of the shaft 20 caused thereby, the hooks 26, 28 can be moved in accordance with the arrow P2 from the locking position into the unlocked position in which the engagement elements 108, 110 are no longer arranged in the recesses 30, 32 and thus an engagement between the hooks 26, 28 and the engagement elements 108, 110 no longer exists.

Figure 3:
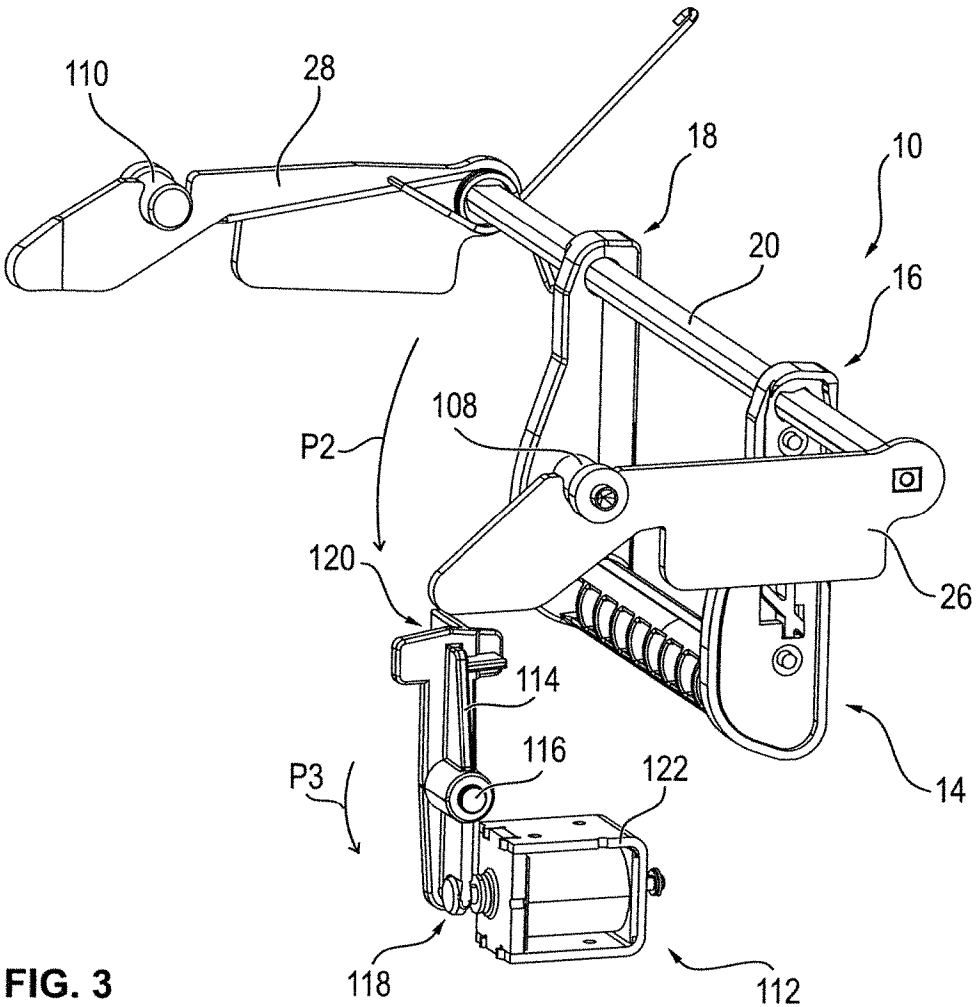
FIG. 3 shows a detail of the device according to FIG. 1 and of the safe bag module according to FIG. 2.
Figure 4:
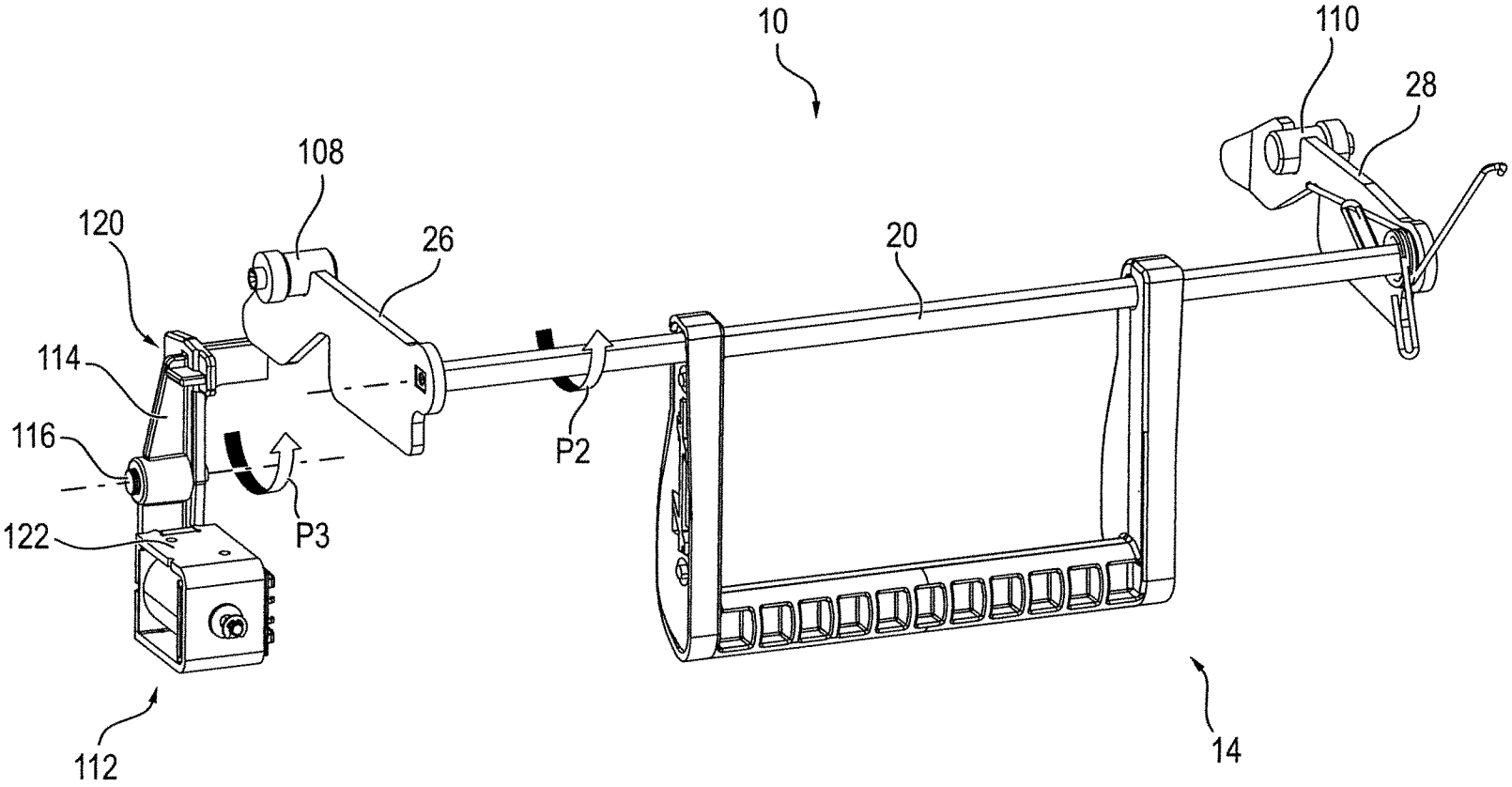
FIG. 4 shows a further detail of the device according to FIG. 1 and of the safe bag module according to FIG. 2.

In FIGS. 3 and 4, each time a schematic, perspective illustration of a detail of the safe bag module 10 and the device 100 is shown, wherein only the handle 14, the shaft 20 as well as the two hooks 26, 28 of the safe bag module 10 are illustrated. Only the two engagement elements 108, 110 of the compartment 102 as well as the locking unit 112 of the device 100 are illustrated.

The locking unit 112 comprises a lever 114 which is arranged pivotably about an axis 116. At a first end 118 of the lever 114, an adjusting unit designed as a lifting magnet 122 is provided, by means of which the pivoting about the axis 116 can be performed. In a first operating state, which is shown in FIG. 3, the lever 114 is arranged such that its second end 120 opposite to the first end 118 contacts the first hook 26 or is arranged underneath this hook only at a slight distance so that a movement of the hook 26 in the direction of the arrow P2 and thus from the locking position into the unlocked position is prevented.

By means of the lifting magnet 122, the lever 114 can be moved in accordance with the arrow P3 from the first operating state into a second operating state, in which the second end 120 no longer contacts the first hook 26 so that it can be moved in the direction of the arrow P2 by rotation of the shaft 20 and thus from the locking position into the unlocked position.

Figure 5:
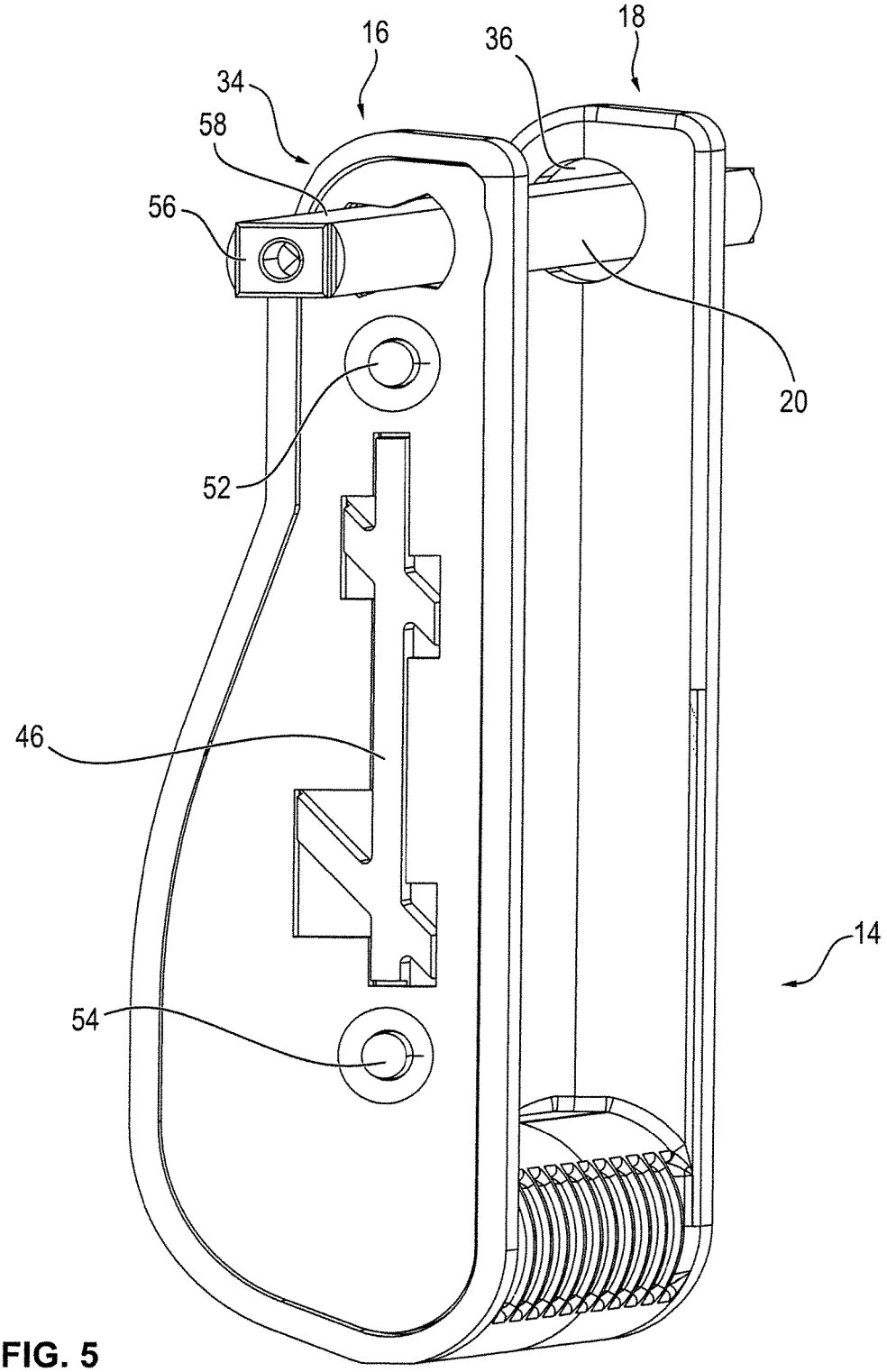
FIG. 5 shows a schematic, perspective illustration of a shaft and a handle of the safe bag module according to FIGS. 2 to 4.

In FIG. 5, a schematic, perspective illustration of the handle 14 as well as of the shaft 20 is shown. The handle 14 has a first hole 34 as well as a second hole 36 through which the shaft 20 extends.

Figure 6:
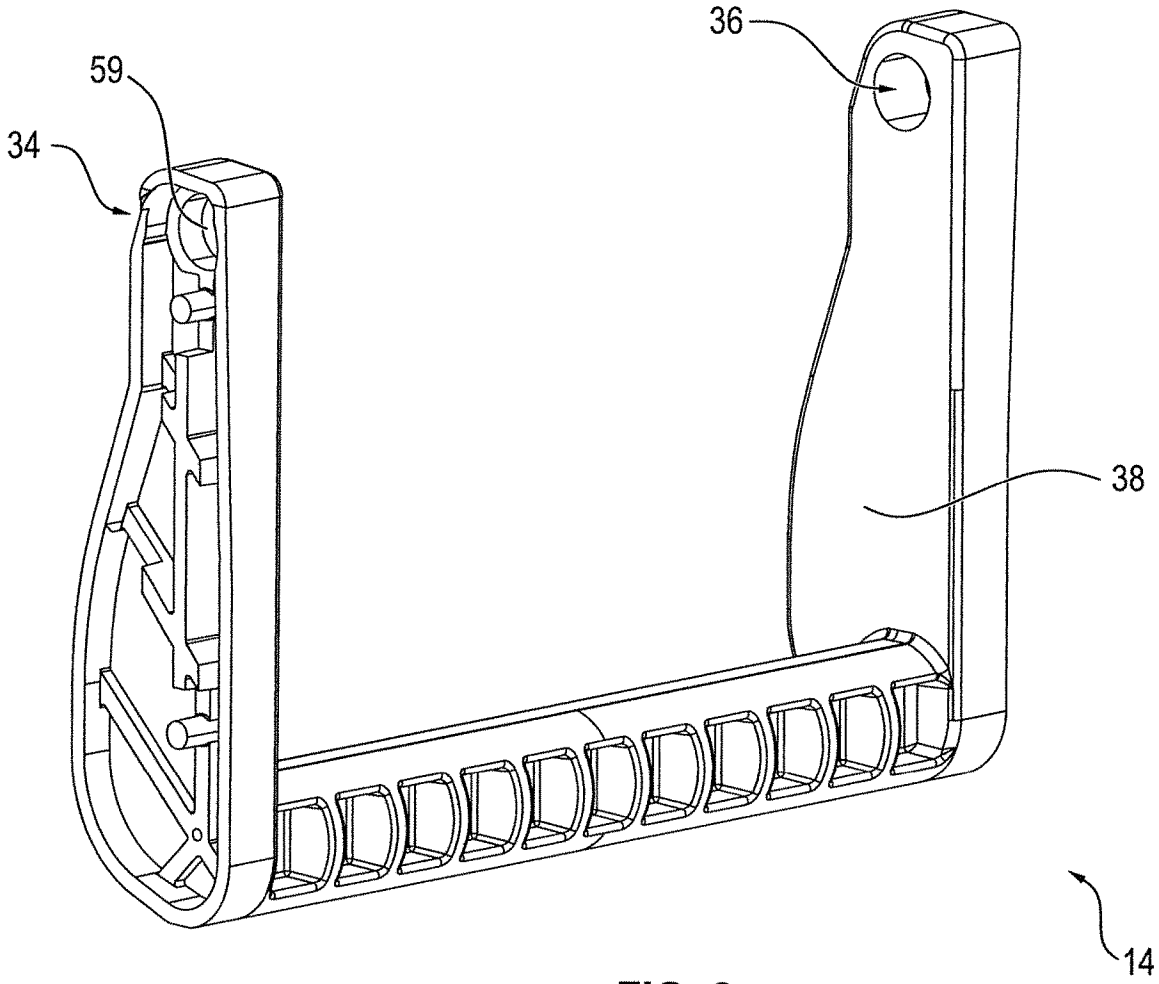
FIG. 6 shows a schematic perspective illustration of a basic body of the handle according to FIG. 5.
Figure 7:
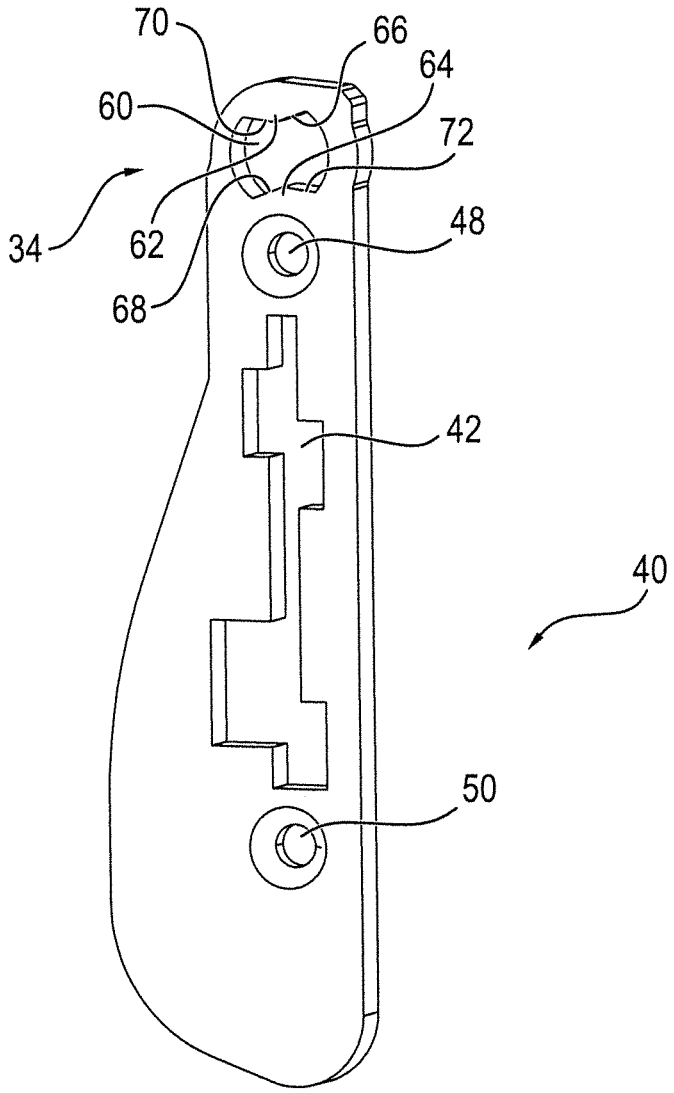
FIG. 7 shows a schematic, perspective illustration of a reinforcing element of the handle according to FIG. 5.

The handle 14 comprises a basic body 38 which is shown in FIG. 6 and is made of plastic. Further, the handle 14 comprises a reinforcing element 40, which is illustrated in FIG. 7 and, as shown in FIG. 5, is arranged on the side of the first end 16 of the handle 14 on the basic body 38. The reinforcing element 40 is in particular made of metal and has a first recess into which ribs 46 of the basic body 38 extend and thus contribute to the force transmission between the reinforcing element 40 and the basic body 38. Moreover, two further recesses 48, 50 are provided in the disk-shaped reinforcing element 40, through which pins 52, 54 extend, which likewise serve to transmit force between the basic body 38 and the reinforcing element 40.

The shaft 20 has a basic body 56 with a rectangular cross-section, wherein on a first side of the basic body 56 a first projection 58 and on a second side of the basic body 56 opposite to the first side a second projection, not visible in FIG. 5, is provided, wherein the second projection is shaped like the first projection. The projections 58 each have a circular-sector-shaped cross-section and extend almost over the entire length of the shaft 20 apart from the end regions at which the hooks 26, 28 are mounted on the shaft 20.

The first hole 34 through which the shaft 20 is passed comprises a first portion 59 which is surrounded by the basic body 38 and a second portion 60 which is delimited by the reinforcing element 40.

The first portion 59 of the first hole 34 and the second hole 36 have a circular cross-section, wherein their diameters are identical and each time larger than the maximum width and the maximum height of the shaft 20. In particular, the diameter is slightly larger than the maximum dimension of the shaft 20, i.e. the distance between the two apexes of the projections 58 of the shaft 20. In particular, the projections 58 have approximately the same curvature as the second hole 36 and the first portion 59 of the first hole 34.

By means of this shape of the shaft 20 and of the second hole 36, it is achieved that when rotating the lever 14 no torque transmission takes place between the second end 18 of the lever 14 and the shaft 20. Likewise, there is no torque transmission between the first portion 59 of the first hole 34 and the shaft 20.

The second portion 60 of the first hole 34, on the other hand, is formed such that the cross-section is formed as a circle into which two projections 62, 64 project.

When the handle 14 is in a zero position shown in FIGS. 2 to 4, in which the handle 14 bears against the housing of the safe bag module 10 then the straight sides of the shaft 20 contact the edges 66 and 68 of the projections 62, 64 of the second portion 60 of the first hole 34. When the handle 14 is now moved in the direction of the arrow P4 out of the zero position, then at first there is no engagement between the shaft 20 and the second portion 60 of the first hole so that the handle 14 at first can be moved away from the housing by a predetermined angle without the shaft 20 being rotated and without there being a torque transmission. As a result, it is at first achieved that a user can easily move the handle 14 away from the housing and can fully grasp it.

When the handle 14 is rotated so far that the flat sides of the shaft 20 bear against the edges 70, 72 of the projections 62, 64, then via this contact a torque is transmitted to the shaft 20.

Provided that the locking unit 112 is in the second operating state, i.e. does not prevent a movement of the first hook 26, both the first hook 26 and the second hook 28 are correspondingly moved from the locking position to the unlocked position by means of the rotation of the shaft 20 so that the safe bag module 10 can be removed.

If, however, the locking unit 112 is in the first operating state, then a downward movement of the first hook 26, i.e. in the direction of the arrow P2 is prevented. The torque transmitted to the shaft 20 via the first end 16 by pulling the lever 14 results in a twisting of the shaft 20.

Since in the case of the handle 14 shown in FIGS. 5 to 7, however, the torque is exclusively transmitted at the first end 16 and thus on the side facing the locking unit 112, there is a considerably lower twisting of the shaft 20 at its second end 24 compared to a "standard handle" in which a force transmission takes place via both ends 16, 18 so that the second hook 28 is not or at least only moved so far in the direction of the arrow P2 by the twisting that the engagement with the engagement element 110 still exists and thus the locking on both sides is guaranteed.

In an alternative embodiment of the invention, the shaft 20 and/or the holes 34, 36 can also be formed differently. It is only important that the torque transmission exclusively takes place via the first end 16 and not via the second end 18.

In addition, in an alternative embodiment of the invention, the lever 14 can also be formed in one piece, i.e. that there is no division into the basic body 38 and the reinforcing element 40.

Moreover, it is alternatively also possible that the entire first hole 34 is formed such as previously described for the second portion 60 only.

In addition, it is likewise possible that the second portion 60 or the entire first hole 34 are designed such that the engagement with the shaft 20 always exists and not such that at first there is a certain play at the beginning when rotating the handle 14 out of the zero position.

When carrying the safe bag module 10, the handle 14 is rotated relative to the zero position by 90° in the direction of the arrow P4. By means of the circular-sector-shaped projections 58 it is achieved that when carrying the safe bag module 10 no or only a very little play exists between the shaft 20 and the handle 14 so that there is a uniform transmission of the weight force of the safe bag module 10 via both ends 16, 18.

Figure 8:
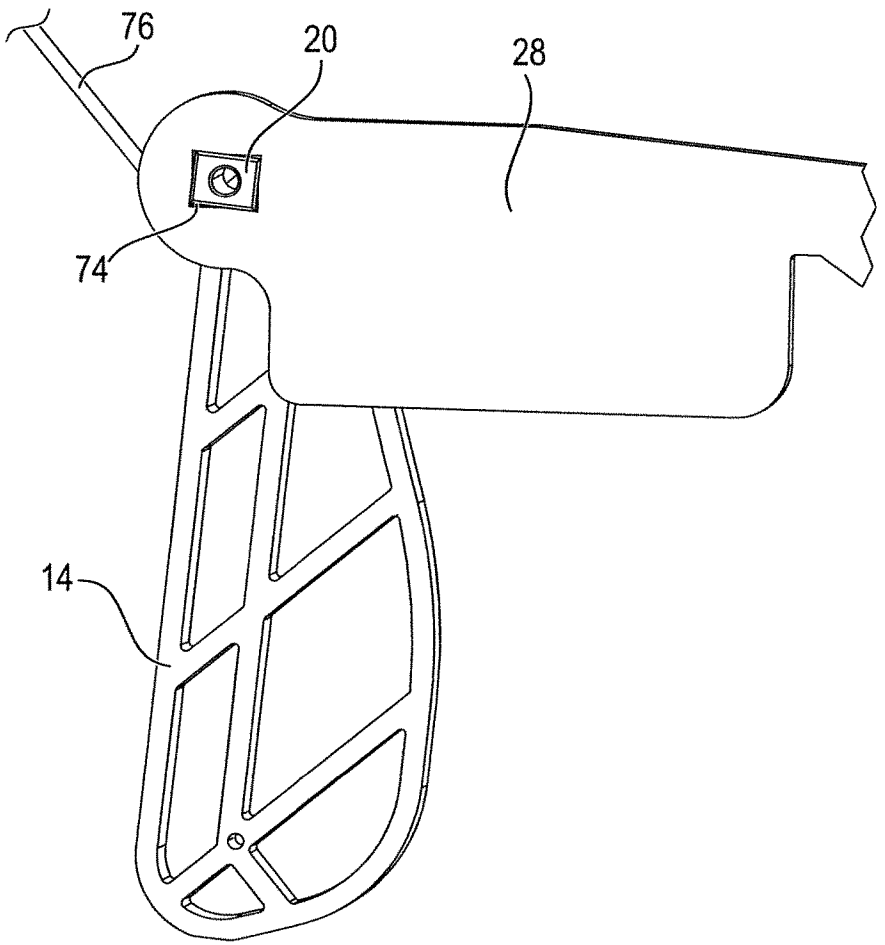
FIG. 8 shows a schematic, perspective illustration of the handle, the shaft and a second hook of the safe bag module according to FIGS. 2 to 7.

In FIG. 8, a schematic, perspective illustration of the handle 14, the shaft 20 as well as of the second hook 28 are shown. The second end 24 of the shaft 20 is received in a recess 74 of the second hook 28, wherein the width of this recess 74 is larger than the width of the cross-section of the shaft 20, and the height of the second recess 74 is likewise higher than the height of the cross-section of the shaft 20. In this way, it is achieved that the second hook 28 is mounted on the shaft 20 with a predetermined play, in particular about 5°. In this way, it is achieved that even when there is still a quite strong twisting at the second end 24 of the shaft 20 despite the only one-sided torque introduction, a rotation of up to 5°, i.e. within the play, does not result in a movement of the second hook 28 so that there will not be a one-sided unlocking.

Further, a spring 76 is provided which is illustrated only schematically in the Figures. By means of this spring 76, the hook 28 is biased in the locking position. Only when the shaft 20 has been rotated further than the predetermined play, the hook 28 is moved against the spring force of the spring 76 from the locking position in the direction of the unlocked position.

In an alternative embodiment of the invention, the one-sided torque transmission can also only be realized via the handle 14, and the hook 28 can be mounted on the shaft 20 without play in a rotationally fixed manner, as this is generally the case for the first hook 26.

In an alternative embodiment, it is likewise possible that the handle 14 is designed such that the torque transmission 26 is accomplished via both ends 16, 18, but the play between the shaft 20 and the second hook 28 is provided.

In both afore-mentioned alternative embodiments, each time the risk of a one-sided unlocking when pulling the lever 14 despite the locking unit 112 being arranged in the first operating mode is reduced. By the combination of both principles, a particularly high safety is achieved.

LIST OF REFERENCE SIGNS

10 safe bag module
12 receiving area
14 handle
16 first end
18 second end
20 shaft
22 first end
24 second end
26, 28 hook
30, 32 recess
34, 36 hole
38 basic body
40 reinforcing element
42, 48, 50 recess
52, 54 pin
56 basic body
58 projection
59, 60 portion
62, 64 projection
66, 68, 70, 72 edge
74 recess
76 spring
100 device
102 compartment
104, 106 side
108, 110 engagement element
112 locking unit
114 lever
116 axis
118, 120 end region
122 lifting magnet
P1 to P4 direction

What is claimed is:

1. A device for receiving notes of value, comprising:
a receiving area for receiving notes of value,
a shaft,
a first hook arranged at a first end of the shaft and a second hook arranged at a second end of the shaft, wherein the first and second hooks, when the device is inserted in a compartment of a device for handling notes of value, are engaged with engagement elements of the device for handling notes of value in a locking position, the engagement elements are arranged within the compartment, and the first and second hooks are not engaged with the engagement elements when in an unlocked position, wherein the first and second hooks are movable between the locking position and the unlocked position by a rotation of the shaft, a handle arranged on the shaft, the handle comprises a first end with a first hole and a second end with a second hole, wherein the shaft runs through the first and the second holes, the first hole is formed such that upon rotation of the handle, at least within a predetermined range of rotation, a torque is transmitted to the shaft via an engagement between the shaft and the first end of the handle, and the second hole is formed such that upon a rotation of the handle there is no torque transmission to the shaft via the second end.

2. The device of claim 1, wherein the second hole has a circular cross-section and the diameter of the second hole is larger than a maximum dimension of a cross-section of the shaft.

3. The device of claim 2, wherein the shaft has a rectangular basic body.

4. The device of claim 3, wherein a projection is formed on each of a first side of the basic body and on a second side of the basis body opposite to the first side, each of the projections having a circular-segment-shaped cross-section and extending at least in areas of the first and the second holes, and that a curvature of the surface of the projections approximately corresponds to an inner curvature of the first and/or second hole.

5. The device of claim 2, wherein the first hole has a circular cross-section into which at least one projection projects.

6. The device of claim 2, wherein the handle comprises a basic body and a reinforcing element in an area of the first end of the handle, wherein a first portion of the first hole extends through the basic body and a second portion of the first hole extends through the reinforcing element.

7. The device of claim 6, wherein the first portion of the first hole has a circular cross-section, and the second portion of the first hole has a circular cross-section into which at least one projection projects.

8. The device of claim 5, wherein the at least one projection is designed such that, starting out from a zero position of the handle, upon a rotation of the handle within a first angular range, the shaft is not engaged with the at least one projection such that no torque transmission takes place, and upon a rotation of the handle within a second angular range following the first angular range there is an engagement between the at least one projection and the shaft via which a transmission of the torque from the handle to the shaft takes place.

9. The device of claim 1, wherein the first hook is mounted on the shaft in a rotationally fixed manner without play, and the second hook is mounted on the shaft with a predetermined play.

10. The device of claim 9, wherein the play is between 3° and 7°.

11. The device of claim 9, wherein the shaft has a rectangular cross-section at its first and second ends, the first hook has a recess into which the first end of the shaft engages, the recess of the first hook has the same cross-section as the first end of the shaft, the second hook has a recess into which the second end of the shaft engages, the recess of the second hook has a rectangular cross-section, and both sides of the rectangular cross-section of the recess of the second hook are larger than respective corresponding sides of the cross-section of the second end of the shaft.

12. The device of claim 9, wherein the second hook is biased on the shaft by means of an elastic element opposite to a direction of rotation into which the shaft has to be rotated for moving the first and second hooks to the unlocked position.

13. A device for receiving notes of value, comprising:

a receiving area for receiving notes of value, a shaft, a handle arranged on the shaft, a first hook arranged at a first end of the shaft and a second hook arranged at a second end of the shaft, wherein the first and second hooks, when the device is inserted in a compartment of a device for handling notes of value, are engaged with engagement elements of the device for handling notes of value in a locking position, which engagement elements are arranged within the compartment, and the first and second hooks are not engaged with the engagement elements in an unlocked position, wherein the first and second hooks are movable between the locking position and the unlocked position by a rotation of the shaft by the handle, wherein the first hook is mounted on the shaft in a rotationally fixed manner without play, and the second hook is mounted on the shaft with a predetermined amount of play.

14. A device for handling notes of value with the compartment for receiving the device for receiving notes of value of claim 1, wherein when the device for receiving notes of value is received in the compartment of the device for handling notes of value, a first engagement element of the engagement elements is arranged on a first side of the compartment and a second engagement element of the engagement elements is arranged on a second side of the compartment opposite to the first side, wherein, in the locking position, the first hook is engaged with the first engagement element and the second hook is engaged with the second engagement element.

15. The device of claim 14, wherein on the first side a locking unit is arranged, which, in a first operating state, prevents a movement of the first hook from the locking position into the unlocked position, and, in a second operating state, enables the movement of the first hook from the locking position into the unlocking position.

16. The device of claim 12, wherein the elastic element is a spring.

17. The device for handling notes of value of claims 13 wherein the device for handling notes of value is an automated teller machine.

18. The device for handling notes of value of claims 14 wherein the device for handling notes of value is an automated teller machine.

19. The device of claim 7, wherein the at least one projection comprises two projections.

* * * * *